US010822733B2

(12) United States Patent
Ekbundit

(10) Patent No.: US 10,822,733 B2
(45) Date of Patent: Nov. 3, 2020

(54) WASHING MACHINE APPLIANCE LID ASSEMBLY INCLUDING A RETRACTABLE HANGER

(71) Applicant: Haier US Appliance Solutions, Inc., Wilmington, DE (US)

(72) Inventor: Michael Wuttikorn Ekbundit, Mount Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 149 days.

(21) Appl. No.: 16/047,056

(22) Filed: Jul. 27, 2018

(65) Prior Publication Data

US 2020/0032443 A1 Jan. 30, 2020

(51) Int. Cl.

| | |
|---|---|
| ***D06F 25/00*** | (2006.01) |
| ***D06F 37/28*** | (2006.01) |
| ***D06F 57/12*** | (2006.01) |
| ***D06F 37/00*** | (2020.01) |

(52) U.S. Cl.

CPC ..... *D06F 25/00* (2013.01); *D06F 37/00* (2013.01); *D06F 37/28* (2013.01); *D06F 57/12* (2013.01)

(58) Field of Classification Search

CPC ..... D06F 37/00

See application file for complete search history.

(56) References Cited

U.S. PATENT DOCUMENTS

| | | | | |
|---|---|---|---|---|
| 9,228,283 | B2 | 1/2016 | Kappler et al. | |
| 2017/0184149 | A1* | 6/2017 | Sutton | F16C 11/0604 |
| 2018/0371800 | A1* | 12/2018 | McDonald | E05B 65/00 |
| 2019/0276976 | A1* | 9/2019 | Leibman | D06F 39/088 |

FOREIGN PATENT DOCUMENTS

| | | | | |
|---|---|---|---|---|
| CN | 205501664 | U | 8/2016 | |
| JP | 2013000239 | A | 1/2013 | |
| JP | 2013172822 | A | 9/2013 | |
| WO | WO-2015130046 | A1 * | 9/2015 | D06F 37/18 |

* cited by examiner

*Primary Examiner* — Michael E Barr
*Assistant Examiner* — Omair Chaudhri
(74) *Attorney, Agent, or Firm* — Dority & Manning, P.A.

(57) ABSTRACT

A lid assembly for a washing machine appliance includes a door body pivotally mounted to a top panel of a cabinet and being moveable between an open position and a closed position. The door body defines one or more slots in a rear side of the door body for receiving a retractable hanger which is movable between an extended position and a retracted position when the door body is in the open position. Lid assembly may further include biasing mechanisms for urging the retractable hanger to the extended or retracted positions and locking mechanisms to fix the position of the retractable hanger.

17 Claims, 7 Drawing Sheets

WASHING MACHINE APPLIANCE LID ASSEMBLY INCLUDING A RETRACTABLE HANGER

FIELD OF THE INVENTION

The present subject matter relates generally to washing machine appliances, and more particularly to integrated garment hanging features for washing machine appliances.

BACKGROUND OF THE INVENTION

Washing machine appliances generally include a wash tub for containing water or wash fluid, e.g., water and detergent, bleach, and/or other wash additives. A wash basket is rotatably mounted within the wash tub and defines a wash chamber for receipt of articles for washing, and an agitation element is rotatably mounted within the wash basket. Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or the agitation element can rotate at various speeds to agitate or impart motion to articles within the wash chamber, to wring wash fluid from the articles, etc.

Even after the completion of a washing process including a spin cycle, articles of clothing may contain some remaining water. If these clothes are not being dried in a dryer appliance, they are typically line dried to allow residual water to drip out or evaporate. Often there is limited laundry room space for hanging garments that need to line dry. Space that is available indoors usually means dripping water onto a floor or other work space that must later be cleaned. Certain washing machine appliances have hangers to permit hanging of wet clothes, but these hangers do not include features for securely stowing the hangers during subsequent operations, resulting in potential safety issues or requiring complete removal after the garment has dried completely.

Accordingly, a washing machine appliance including features for drying garments would be useful. More specifically, an integrated garment hanging feature for a washing machine appliance that may conveniently hang garments and be safely stowed prior to subsequent use would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided including a cabinet, a wash tub positioned within the cabinet and defining a wash chamber for receipt of a load of articles for washing, and a top panel positioned over the wash tub and defining an opening for accessing the wash chamber. A lid assembly provides selective access to the wash chamber and includes a door body pivotally mounted to the top panel and moveable between an open position and a closed position. A retractable hanger is slidably mounted to the door body and is movable between an extended position and a retracted position.

In another exemplary embodiment, a lid assembly for a washing machine appliance is provided. The washing machine appliance includes a wash tub positioned within a cabinet and a top panel positioned over the wash tub and defining an opening for accessing the wash tub. The lid assembly includes a door body pivotally mounted to the top panel and moveable between an open position and a closed position, the door body defining one or more slots in a rear side of the door body. A retractable hanger is slidably mounted within the one or more slots in the door body and is movable between an extended position and a retracted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
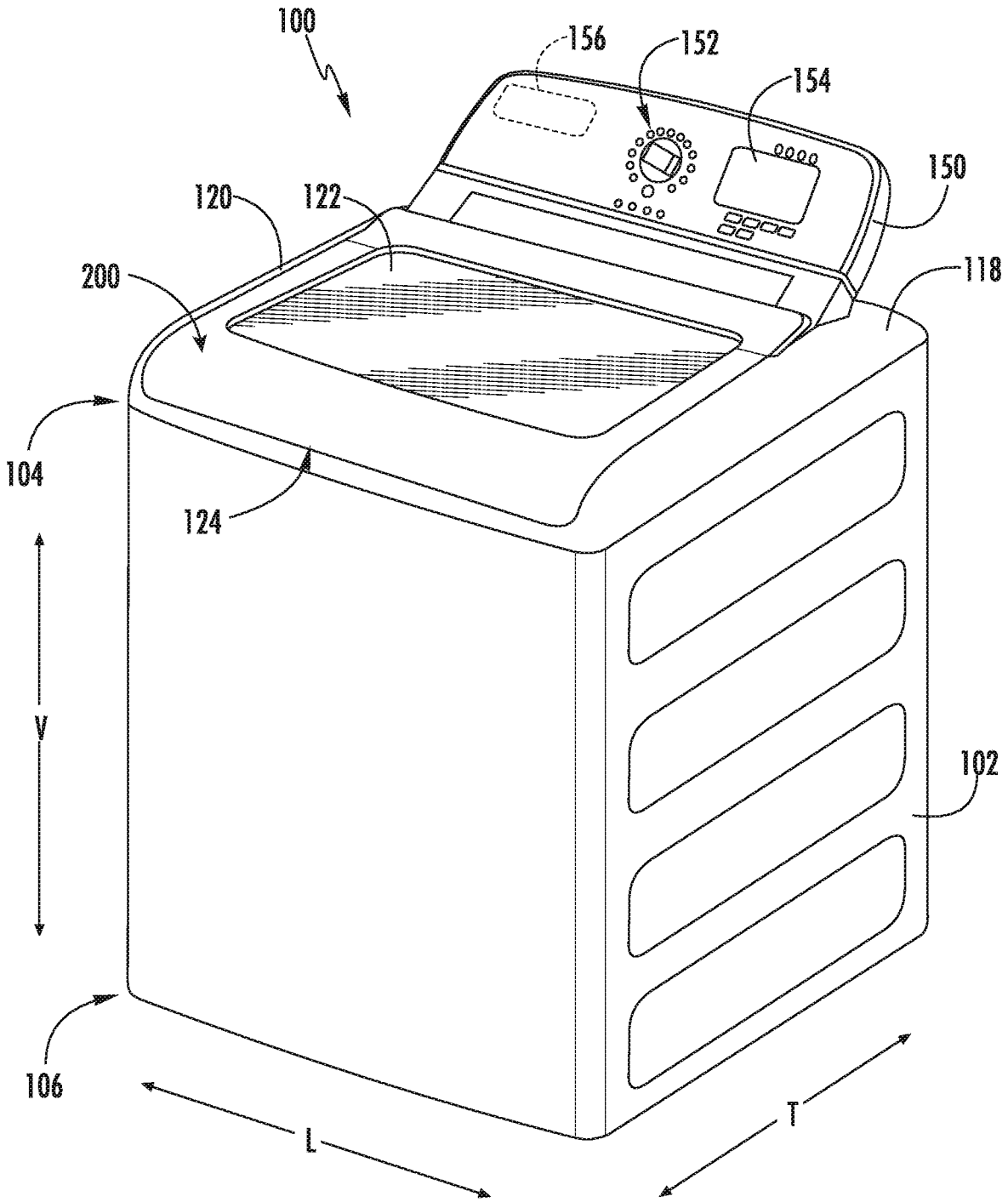
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
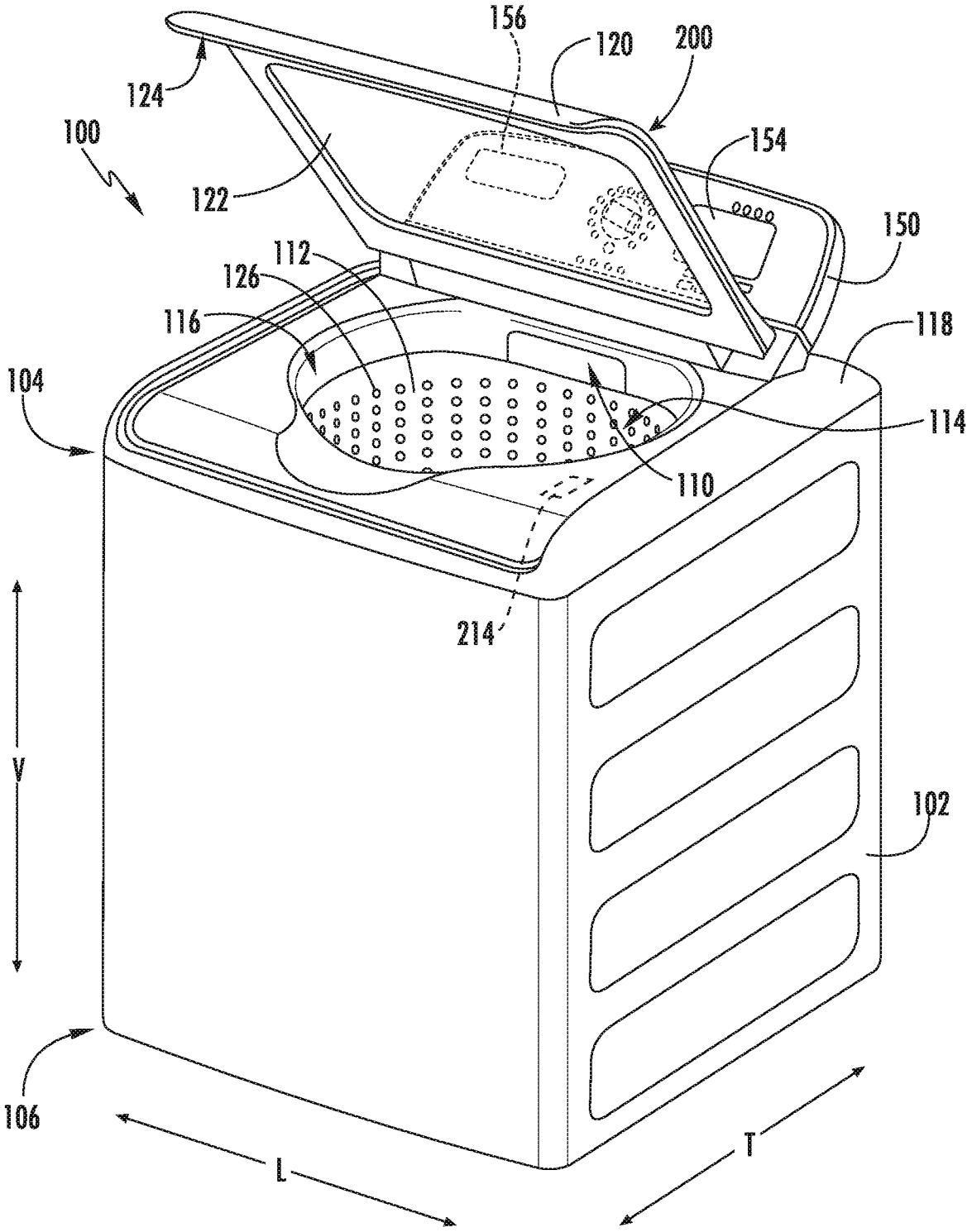
FIG. 2 provides a perspective view of the exemplary washing machine appliance of FIG. 1 with the door of the exemplary washing machine appliance shown in an open position.
Figure 3:
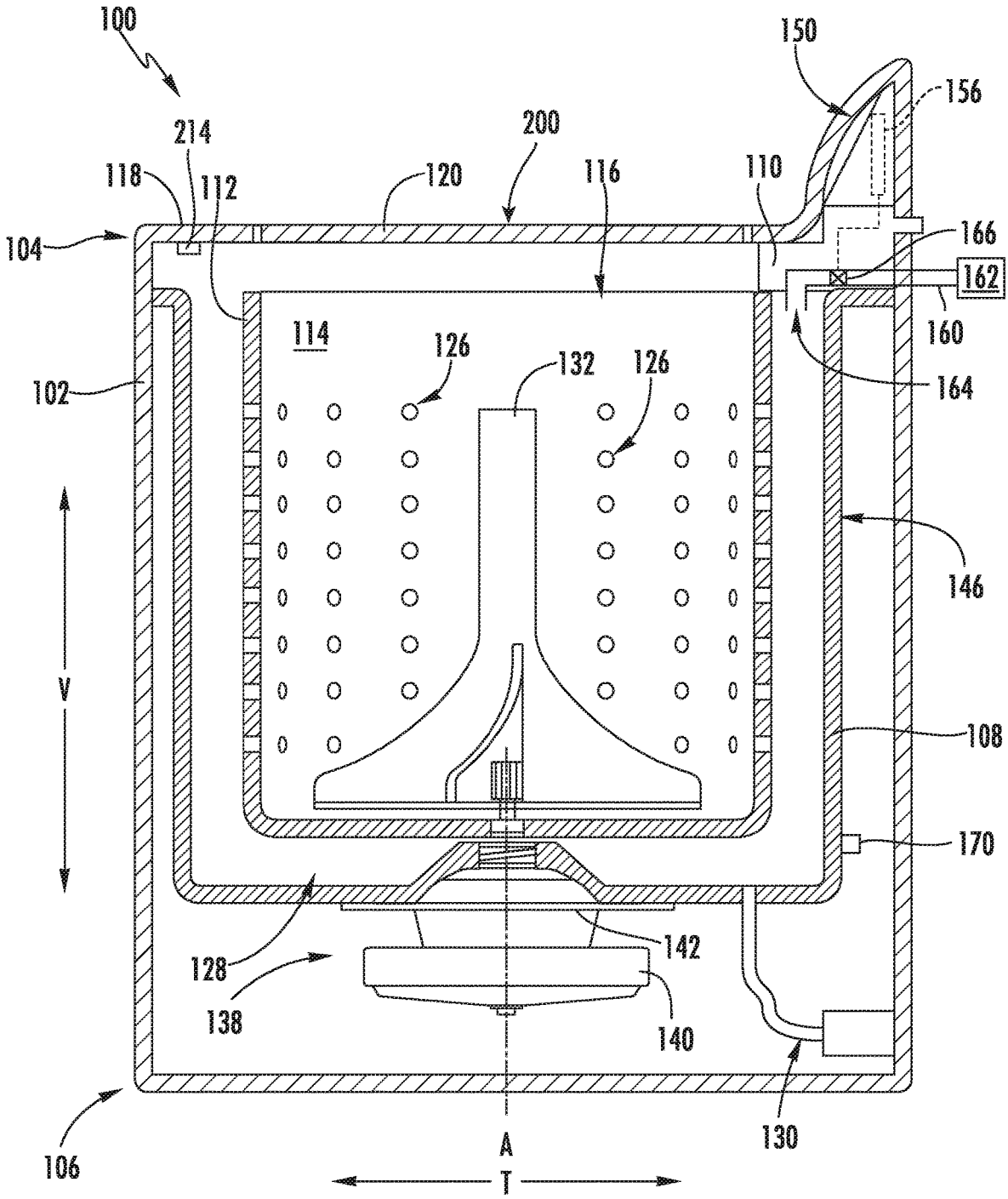
FIG. 3 provides a side, cross sectional view of the exemplary washing machine appliance of FIG. 1 according to an exemplary embodiment of the present subject matter.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100, respectively. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V. As best shown in FIG. 3, a wash tub 108 is positioned within cabinet 102 and is generally configured for retaining wash fluids during an operating cycle. Washing machine appliance 100 further includes a primary dispenser 110 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 100 includes a wash basket 112 that is positioned within wash tub 108 and generally defines a wash chamber 114 including an opening 116 for receipt of articles for washing. More specifically, wash basket 112 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well. As used herein, terms of approximation, such as "approximately," "substantially," or "about," refer to being within a ten percent margin of error.

As illustrated, cabinet 102 of washing machine appliance 100 has a top panel 118. Top panel 118 defines an opening (FIG. 2) that coincides with opening 116 of wash basket 112 to permit a user access to wash basket 112. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and wash tub 108. In this regard, wash basket 112 is spaced apart from wash tub 108 to define a space for wash fluid to escape wash chamber 114. During a spin cycle, wash fluid within articles of clothing and within wash chamber 114 is urged through perforations 126 wherein it may collect in a sump 128 defined by wash tub 108. Washing machine appliance 100 further includes a pump assembly 130 (FIG. 3) that is located beneath wash tub 108 and wash basket 112 for gravity assisted flow when draining wash tub 108.

An impeller or agitation element 132 (FIG. 3), such as a vane agitator, impeller, auger, oscillatory basket mechanism, or some combination thereof is disposed in wash basket 112 to impart an oscillatory motion to articles and liquid in wash basket 112. More specifically, agitation element 132 extends into wash basket and assists agitation of articles disposed within wash basket 112 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 112 are oriented to rotate about axis of rotation A (which is substantially parallel to vertical direction V).

As best illustrated in FIG. 3, washing machine appliance 100 includes a drive assembly 138 in mechanical communication with wash basket 112 to selectively rotate wash basket 112 (e.g., during an agitation or a rinse cycle of washing machine appliance 100). In addition, drive assembly 138 may also be in mechanical communication with agitation element 132. In this manner, drive assembly 138 may be configured for selectively rotating or oscillating wash basket 112 and/or agitation element 132 during various operating cycles of washing machine appliance 100.

More specifically, drive assembly 138 may generally include one or more of a drive motor 140 and a transmission assembly 142, e.g., such as a clutch assembly, for engaging and disengaging wash basket 112 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 112 through opening 116, and washing operation is initiated through operator manipulation of input selectors 152. Wash basket 112 is filled with water and detergent and/or other fluid additives via primary dispenser 110. One or more valves can be controlled by washing machine appliance 100 to provide for filling wash tub 108 and wash basket 112 to the appropriate level for the amount of articles being washed and/or rinsed. By way of example for a wash mode, once wash basket 112 is properly filled with fluid, the contents of wash basket 112 can be agitated (e.g., with agitation element 132 as discussed previously) for washing of laundry items in wash basket 112.

More specifically, referring again to FIG. 3, a water fill process will be described according to an exemplary embodiment. As illustrated, washing machine appliance 100 includes a water supply conduit 160 that provides fluid communication between a water supply source 162 (such as a municipal water supply) and a discharge nozzle 164 for directing a flow of water into wash chamber 114. In addition, washing machine appliance 100 includes a water fill valve or water control valve 166 which is operably coupled to water supply conduit 160 and communicatively coupled to controller 156. In this manner, controller 156 may regulate the operation of water control valve 166 to regulate the amount of water within wash tub 108. In addition, washing machine appliance 100 may include one or more pressure sensors 170 for detecting the amount of water and or clothes within wash tub 108. For example, pressure sensor 170 may be operably coupled to a side 146 of tub 108 for detecting the weight of wash tub 108, which controller 156 may use to determine a volume of water in wash chamber 114 and a subwasher load weight.

After wash tub 108 is filled and the agitation phase of the wash cycle is completed, wash basket 112 can be drained, e.g., by drain pump assembly 130. Laundry articles can then be rinsed by again adding fluid to wash basket 112 depending on the specifics of the cleaning cycle selected by a user. The impeller or agitation element 132 may again provide agitation within wash basket 112. One or more spin cycles may also be used as part of the cleaning process. In particular, a spin cycle may be applied after the wash cycle and/or after the rinse cycle in order to wring wash fluid from the articles being washed. During a spin cycle, wash basket 112 is rotated at relatively high speeds to help wring fluid from the laundry articles through perforations 126. After articles disposed in wash basket 112 are cleaned and/or washed, the user can remove the articles from wash basket 112, e.g., by reaching into wash basket 112 through opening 116.

Referring now to FIGS. 4 through 7, a lid assembly 200 will be described according to an exemplary embodiment of the present subject matter. Lid assembly 200 may be used with washing machine appliance 100, e.g., functioning as door 120 described above. In addition, lid assembly 200 may be used in other washing machine appliances, including both vertical and horizontal axis washing machine appliances. As described in detail below, lid assembly 200 includes features for conveniently hanging garments after a wash cycle and safely storing these features prior to a subsequent operating cycle. More specifically, lid assembly 200 facilitates line drying of wet or damp articles of clothing over wash tub 108 to prevent water from dripping outside of washing machine appliance 100 and facilitating quick and convenient drying of clothes.

Figure 4:
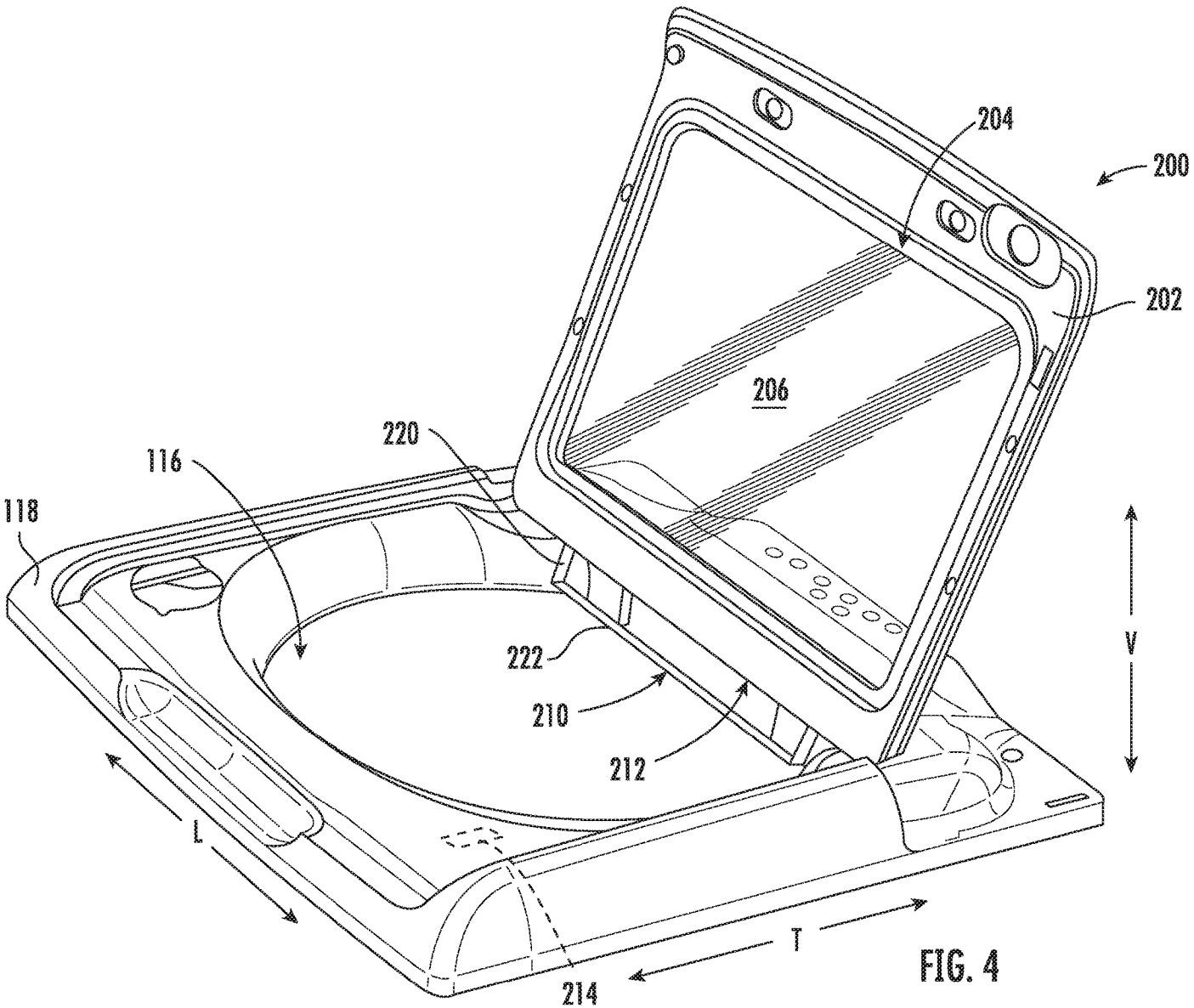
FIG. 4 provides a perspective view of a top panel and a lid assembly that may be used with the exemplary washing machine appliance of FIG. 1 according to example embodiments of the present subject matter.

As illustrated, lid assembly 200 generally includes a door frame or door body 202 that is pivotally mounted to top panel 118 and is movable between an open position (e.g., as shown in FIGS. 2 and 4) and a closed position (e.g., as shown in FIGS. 1 and 3). In this manner, door body 202 provides selective access to wash chamber 114 and may generally be closed during operating cycles but opened to permit a user to add or remove clothes, add detergent, etc. As explained briefly above, door body 202 may further define a central opening 204 within which a window 206 (e.g. the same or similar to window 122) may be mounted to permit viewing of wash chamber 114 through lid assembly 200.

Figure 5:
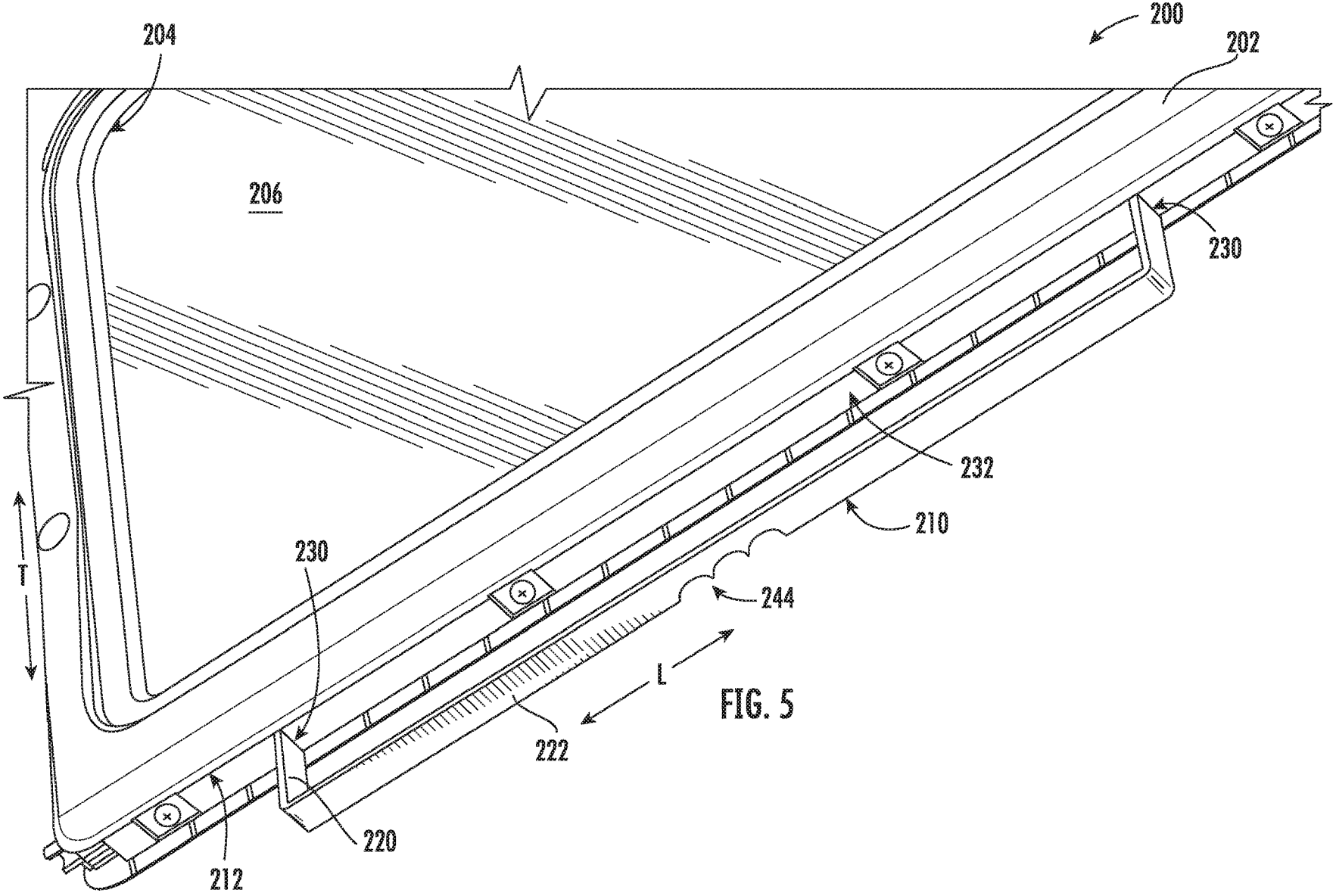
FIG. 5 provides a bottom perspective view of the exemplary lid assembly of FIG. 4, with a retractable hanger illustrated in an extended position.
Figure 6:
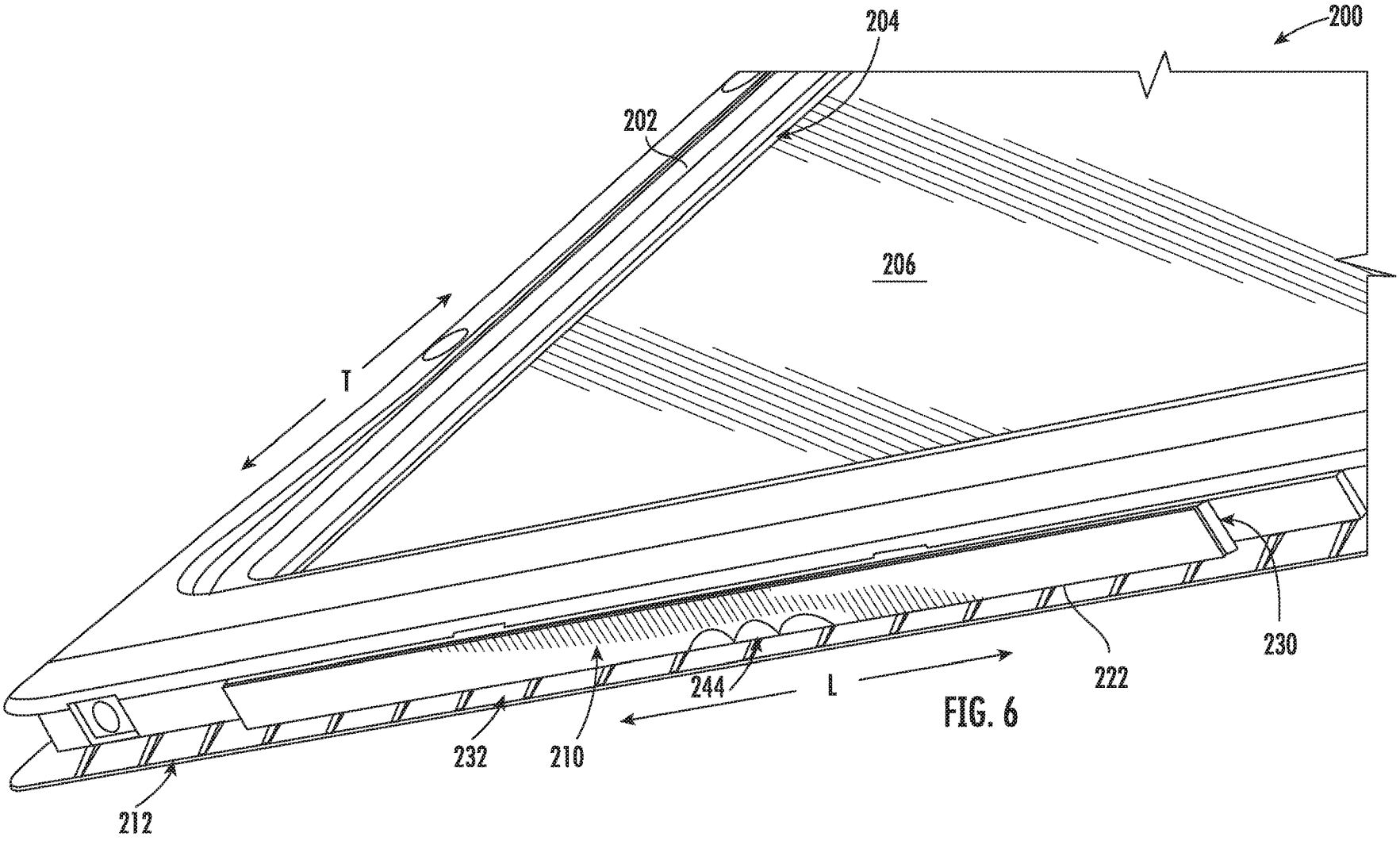
FIG. 6 provides a bottom perspective view of the exemplary lid assembly of FIG. 4, with the retractable hanger illustrated in a retracted position.
Figure 7:
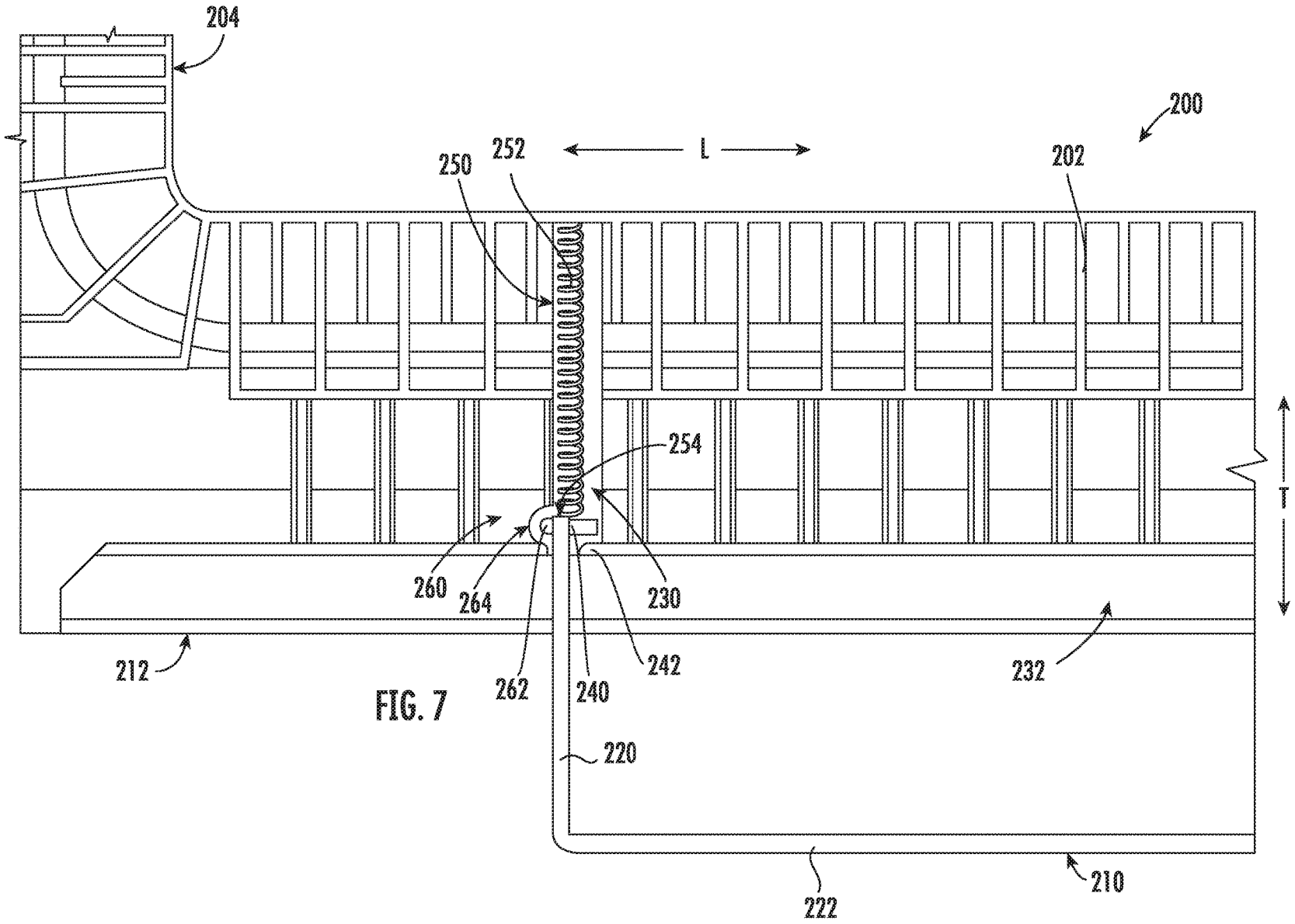
FIG. 7 provides a cross sectional view of the exemplary lid assembly of FIG. 4, with the retractable hanger illustrated in an extended position.

Referring still to FIGS. 4 through 7, lid assembly 200 may further include a retractable hanger 210 that is slidably mounted to door body 202 and is movable between an extended position (e.g., as shown in FIGS. 4, 5, and 7) and a retracted position (e.g., as shown in FIGS. 2 and 6). Specifically, according to the illustrated embodiment, retractable hanger 210 is slidably mounted within a rear side 212 of door body 202. Notably, by mounting retractable hanger 210 within rear side 212 of door body 202, retractable hanger 210 is positioned over wash tub 108 when in the extended position, such that any water dripping from hanging clothes drips into wash tub 108 and collects within sump 128.

Furthermore, by mounting retractable hanger 210 within rear side 212 of door body 202, a user cannot close door body 202 without moving retractable hanger 210 to the retracted position. Thus, controller 156 of washing machine appliance 100 may know with certainty that retractable hanger 210 is not positioned within wash chamber 114 if a door switch 214 (see, e.g., FIGS. 2 and 4) indicates that door body 202 is closed. By contrast, conventional hanging features may extend into wash chamber 114 if not removed or retracted prior to beginning the next wash cycle, thus resulting in dangerous operating conditions and safety issues.

Still referring to FIGS. 4 through 7, retractable hanger 210 generally includes at least one slide arm 220 that is slidably mounted to door body 202. In addition, retractable hanger 210 includes a cross member 222 that may extend substantially perpendicular to slide arm 220, e.g., parallel to rear side 212 of door body 202. In this manner, cross member 222 provides a laterally extending support member on which items of clothing may hang while slide arm 220 supports the weight of such items through door body 202.

In addition, as best shown in FIGS. 5 through 7, door body 202 may define one or more slots 230 for receiving slide arms 220 when retractable hanger 210 is moved toward the retracted position. Specifically, as illustrated, slots 230 extend through door body 202 substantially along the transverse direction T (e.g., when door body 202 is closed) and are configured to guide slide arms 220. In addition, according to the illustrated embodiment, slots 230 may define a depth deep enough to receive substantially all of slide arms 220 (e.g., such that retractable hanger 210 may be recessed fully into door body 202). In addition, as best shown in FIGS. 5 and 6, door body 202 may define an elongated recess 232 that extends substantially along the lateral direction L for receiving cross member 222. In this regard, elongated recess 232 may define a depth sufficient to receive a full height of cross member 222, such that cross member 222 sits flush with rear side 212 of door body 202 when retractable hanger 210 is in the retracted position.

Specifically, the illustrated embodiment shows retractable hanger 210 having two slide arms 220 that extend along the transverse direction T (e.g., when door body 202 is closed) and are spaced apart along the lateral direction L. The single cross member 222 extends between a distal end of the two slide arms 220 substantially parallel to rear side 212 of door body 202 to form a U-shaped retractable hanger 210. However, it should be appreciated that according to alternative embodiments, retractable hanger 210 may have any other suitable size, position, configuration, and/or orientation. For example, retractable hanger 210 may include three slide arms 220 that are received within three slots 230 on door body to form a W-shaped retractable hanger 210.

In addition, retractable hanger 210 and slots 230 may define features for preventing retractable hanger 210 from being pulled past the extended position and out of door body 202. In this regard, for example, as best shown in FIG. 7, slide arm 220 may include a flange 240 that extends in a direction other than the transverse direction T, e.g., such as along the lateral direction L. Flange 240 may be configured for seating on a shoulder 242 defined by door body 202 at an end of each slot 230, e.g. proximate rear side 212. In this manner, flange 240 and shoulder 242 act as a positive stop to prevent retractable hanger 210 from being pulled out of door body 202.

According to an exemplary embodiment, in order to facilitate easy access to and gripping of retractable hanger 210, a handle feature 244 may be defined by or mounted to cross member 222. In this regard, for example, handle feature 244 may be a cutout or aperture in cross member 222 through which a user may insert one or more fingers to pull down on retractable hanger 210. According to alternative embodiments, handle feature 244 may be an extended grip or handle that extends away from cross member 222 but which may still be received within elongated recess 232 when retractable hanger 210 is moved to the retracted position. It should be appreciated that other handle features 244 are possible and within the scope of the present subject matter.

Referring now specifically to FIG. 7, lid assembly 200 may include a variety of features to ensure that retractable hanger 210 is urged toward the desired position and may be fixed in that position as needed. For example, lid assembly 200 may include a biasing mechanism 250 which is operably coupled to retractable hanger 210 for urging retractable hanger 210 to the extended position or the retracted position. According to the illustrated embodiment, biasing mechanism 250 is a spring element 252 that is mechanically coupled to an end 254 of one or more slide arms 220 of retractable hanger 210. As illustrated, spring element 252 is in tension when retractable hanger 210 is in the extended position, e.g., such that spring element 252 continuously urges retractable hanger 210 toward the retracted position. However, it should be appreciated that according to alternative embodiments, spring element 252 may be designed to instead continuously urge retractable hanger 210 toward the extended position.

Lid assembly 200 may further include one or more locking mechanisms 260 for locking or fixing retractable hanger 210 in either the extended position or the retracted position. Specifically, as illustrated, locking mechanism 260 includes a protruding feature 262 defined on slide arm 220 and complementary recess 264 defined by door body 202 within slots 230. Thus, when a user pulls retractable hanger 210 to the extended position, protruding feature 262 may snap into complementary feature 264 to fix retractable hanger 210 in the extended position.

According to the illustrated embodiment, protruding feature 262 is a simple bump defined on one side of slide arm 220 while complementary feature 264 is a small divot for receiving the bump. However, it should be appreciated that according to alternative embodiments any other suitable locking feature or locking mechanism 260 may be used. Specifically, for example, locking mechanism 260 may be a mechanical snap, a spring-loaded locking feature, a pivoting locking clasp, a locking magnet assembly, or any other suitable feature or features for temporarily preventing motion of retractable hanger 210. In addition, although locking mechanism 260 is illustrated as locking slide arm 220 in the extended position, it should be appreciated that according to alternative embodiments locking mechanisms 260 could instead lock retractable hanger 210 in the retracted position. All of these variations and modifications are contemplated as within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet and defining a wash chamber for receipt of a load of articles for washing;

a top panel positioned over the wash tub and defining an opening for accessing the wash chamber; and a lid assembly for providing selective access to the wash chamber, the lid assembly comprising:

a door body pivotally mounted to the top panel and moveable between an open position and a closed position;

a retractable hanger slidably mounted to the door body and being movable between an extended position and a retracted position, the retractable hanger comprising at least one slide arm slidably mounted to the door body and a cross member extending substantially perpendicular to the at least one slide arm, and wherein the retractable hanger is positioned within the door body when in the retracted position; and a biasing mechanism positioned within the door body for urging the retractable hanger to the extended position or the retracted position.

2. The washing machine appliance of claim 1, wherein the biasing mechanism comprises a spring element mechanically coupled to an end of a slide arm of the retractable hanger.

3. The washing machine appliance of claim 1, wherein the lid assembly comprises:

a locking mechanism for selectively locking the retractable hanger in either the extended position or the retracted position.

4. The washing machine appliance of claim 3, wherein the locking mechanism is a protruding feature defined on one of the door body and a slide arm and a complementary recess defined on the other of one of the door body and the slide arm.

5. The washing machine appliance of claim 3, wherein the locking mechanism is a mechanical snap, a spring-loaded feature, or a pivoting locking clasp.

6. The washing machine appliance of claim 1, wherein the retractable hanger is slidably mounted in a rear side of the door body.

7. The washing machine appliance of claim 1, wherein the door body defines a central opening, the lid assembly further comprising:

a window positioned within the central opening.

8. The washing machine appliance of claim 1, wherein the door body defines one or more slots for receiving the at least one slide arm when the retractable hanger is moved toward the retracted position.

9. The washing machine appliance of claim 1, wherein the retractable hanger comprises:

two slide arms received within two slots of the door body; and a cross member that extends between the two slide arms and is substantially parallel to a rear side of the door body to form a U-shaped retractable hanger.

10. The washing machine appliance of claim 9, wherein the door body defines an elongated recess for receiving the cross member such that the cross member sits flush with a rear side of the door body when the retractable hanger is in the retracted position.

11. The washing machine appliance of claim 9, wherein the cross member defines a handle feature to permit a user to grip and move the retractable hanger between the extended position and the retracted position.

12. The washing machine appliance of claim 1, wherein the retractable hanger is in the retracted position when the door body is in the closed position.

13. The washing machine appliance of claim 1, wherein the retractable hanger is positioned over the wash chamber when in the extended position.

14. The washing machine appliance of claim 1, wherein the washing machine appliance is a top load washing machine appliance.

15. A lid assembly for a washing machine appliance, the washing machine appliance comprising a wash tub positioned within a cabinet and a top panel positioned over the wash tub and defining an opening for accessing the wash tub, the lid assembly comprising:

a door body pivotally mounted to the top panel and moveable between an open position and a closed position, the door body defining one or more slots in a rear side of the door body;

a retractable hanger slidably mounted within the one or more slots in the door body and being movable between an extended position and a retracted position, the retractable hanger comprising at least one slide arm slidably mounted to the door body and a cross member extending substantially perpendicular to the at least one slide arm; and a biasing mechanism positioned within the door body for urging the retractable hanger to the extended position or the retracted position.

16. The lid assembly of claim 15, wherein the biasing mechanism comprises a spring element mechanically coupled to an end of the at least one slide arm of the retractable hanger.

17. The lid assembly of claim 15, comprising:

a locking mechanism for selectively locking the retractable hanger in either the extended position or the retracted position.

* * * * *